US006561315B2

(12) United States Patent
Furuya et al.

(10) Patent No.: US 6,561,315 B2
(45) Date of Patent: May 13, 2003

(54) LUBRICATING SYSTEM FOR OHC ENGINE

(75) Inventors: Akira Furuya, Tokyo (JP); Takao Sakai, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/864,071

(22) Filed: May 22, 2001

(65) Prior Publication Data

US 2002/0007983 A1 Jan. 24, 2002

(30) Foreign Application Priority Data

May 23, 2000 (JP) ..... 2000-150850

(51) Int. Cl.[7] ..... F01M 1/00; F01M 9/06
(52) U.S. Cl. ..... 184/13.1; 123/190.3
(58) Field of Search ..... 184/11.4, 11.1, 184/11.2, 13.1; 74/579 R, 587, 579 E, 605; 123/196 R, 196 M, 190.3

(56) References Cited

U.S. PATENT DOCUMENTS 766,382 A * 8/1904 Potter ..... 184/109
878,783 A * 2/1908 Downie ..... 123/41.38
1,093,659 A * 4/1914 Thornley ..... 123/196 R
1,558,885 A * 10/1925 Hunt ..... 184/11.4
1,837,825 A * 12/1931 Mead ..... 184/11.4
1,936,101 A * 11/1933 Baits et al. ..... 184/11.4
2,050,723 A * 8/1936 McMillin ..... 184/11.4
2,200,051 A * 5/1940 Badertscher ..... 184/11.4
2,449,227 A * 9/1948 Hobart ..... 184/11.4
2,498,019 A * 2/1950 Thompson ..... 184/11.4
3,088,783 A * 5/1963 Conover ..... 29/898.12
4,628,878 A * 12/1986 Nakano et al. ..... 123/195 C
4,723,237 A * 2/1988 Andrew et al. ..... 370/204

FOREIGN PATENT DOCUMENTS

JP 8177441 7/1996
JP 10280932 10/1998

* cited by examiner

*Primary Examiner*—David Fenstermacher
(74) *Attorney, Agent, or Firm*—Martin A. Farber

(57) ABSTRACT

A scraper is provided in a large end portion of a connecting rod in an inclined type of overhead camshaft engine to lubricate a timing system by dipping a lubricating oil stored in a lower portion of a crank case up. The scraper includes a bottom wall and a side wall set up on the bottom wall, and have a substantially L-shaped cross-section. An angle between the bottom wall and the side wall is set in a range of 60° to 90°. Thus, the droplets of the oil can be splashed to the side direction of scraper also in three-dimensional inclined direction, so that oil can be securely supplied to and lubricate the timing system which is offset from the scraper in a longitudinal direction of the crankshaft.

6 Claims, 3 Drawing Sheets

LUBRICATING SYSTEM FOR OHC ENGINE

BACKGROUND OF THE INVENTION

The present invention relates to a lubricating system for an overhead camshaft engine (hereinafter referred to simply as "OHC engine"), in particular, to an effective technique applied to the OHC type of general-purpose engine, a cylinder axis of which is located with an inclination with respect to the gravitational direction.

In the prior art, an overhead valve (hereinafter referred to simply as "OHV") and OHC type of general-purpose engines have been widely used as power sources for mowers, power sprayers, power generators, etc. For example, Japanese Patent Application Laid-open Publication No. Hei. 10-280932 discloses an engine of the OHV type, a cylinder axis of which is inclined in order to realize a compact size of the system. Further, Japanese Patent Application Laid-open Publication No. Hei. 8-177441 discloses an engine of the OHC type, an oil dipper of which rotates together with a crankshaft to improve a lubricating performance for a valve-operating system.

In such a general-purpose engine, a so-called splash method has been widely employed as a lubricating method of such a valve-operating system as chains, sprockets, and cams for reducing cost and size. In this splash method, an oil pump is not used, but is used the oil dipper in order to pick up a lubricating oil in an oil pan, so that splashes of the oil lubricates the system. As the oil dipper, while a paddle type is disclosed in the Publication No. Hei. 10-280932, a water mill wheel type is disclosed in the Publication No. Hei. 8-177441.

However, there was a problem of resulting in a cost up by increasing the number of components and in a complicated structure in the case of the lubricating system as described in the Publication No. Hei. 8-177441 since the oil dipper is disposed on an axis different from that of a crankshaft. In addition, there was also a problem of causing not only a large stirring resistance to become a rotational load, but also a raised oil temperature since the water mill wheel dips the lubricating oil up from the oil pan. Furthermore, there was a disadvantage that the height of the engine is increased by the height of the oil dipper.

On the other hand, the system of the Publication No. Hei. 10-280932 dips the oil up by means of the dipper mounted on a large end portion of a connecting rod, thereby lubricating the valve-operating system without increasing the number of components. In addition, this system can cause less stirring resistance, resulting in less raised oil temperature, since the paddle type of dipper moves as cutting the oil. Although, however, such a dipper can splash the oil along the circumference direction of the connecting rod, the dipper can not splash it toward a side of the connecting rod. Therefore, the valve-operating system of OHC engine can not be well lubricated by such a dipper since the valve-operating system deviates from the connecting rod in the longitudinal direction of the crankshaft.

Namely, in the OHV engine as described in the Publication No. Hei. 10-280932, the valve-operating system can be well lubricated by the paddle type of dipper since a valve-operating cam can be disposed in the vicinity of the oil dipper. In the OHC engine, however, a timing valve-operating member such as a chain or a cogged belt is offset from the connecting rod, so that the oil can not be splashed to the place of the chain by the dipper of the paddle type.

SUMMARY OF THE INVENTION

An object of the present invention is to securely supply a lubricating oil to a timing system without increasing the number of components in an OHC general-purpose engine.

In order to achieve the above mentioned object, there is provided a lubricating system of an overhead camshaft engine having a valve-operating cam provided on a cylinder head of the engine and driven in synchronization with a crankshaft via a timing system which comprises a scraper provided on a large end portion of a connecting rod of the engine in order to pick up a lubricating oil stored in a lower portion of a crankcase of the engine so as to lubricate the timing system. The scraper includes a bottom wall extending in a radial direction of the crankshaft and a side wall erected from the bottom wall.

According to the present invention, droplets of the oil can be splashed in the three-dimensional inclined direction, i.e., to the side direction of the scraper. Therefore, the droplets of the oil can be supplied to the timing system offsetted to the scraper in a longitudinal direction of the crankshaft. Thus, the timing system of the OHC engine can be securely lubricated without increasing the number of the components even though being offsetted from the scraper, In this case, the engine may be an inclined type of OHC engine which has a cylinder axis, inclined with respect to the gravitational direction. In addition, an angle formed between the bottom wall and the side wall may be appropriately set within a range of 60° to 90°.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Figure 1:
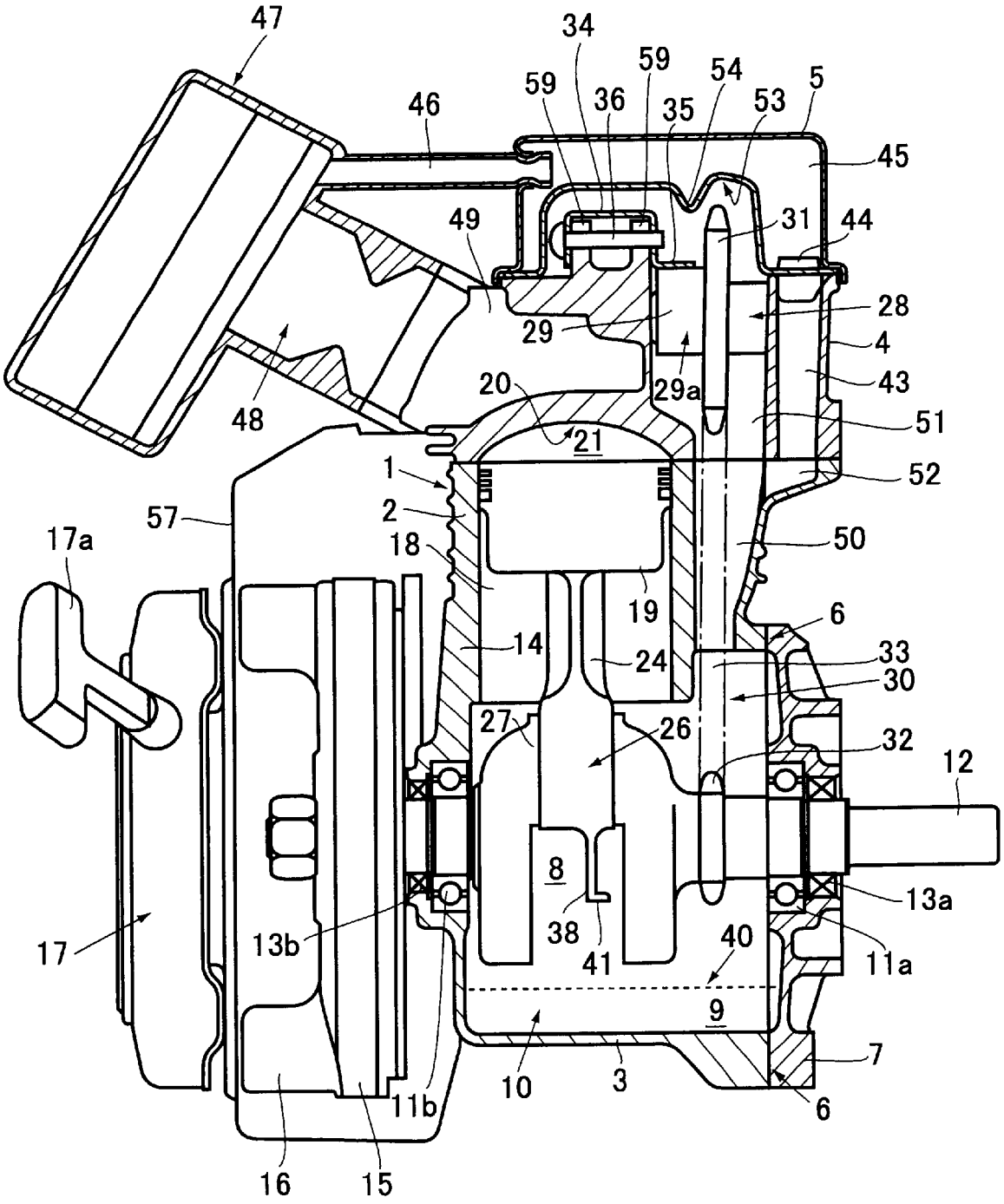
FIG. 1 is a diagram illustrating a structure of an OHC engine using a lubricating system according to one embodiment of the present invention.
Figure 2:
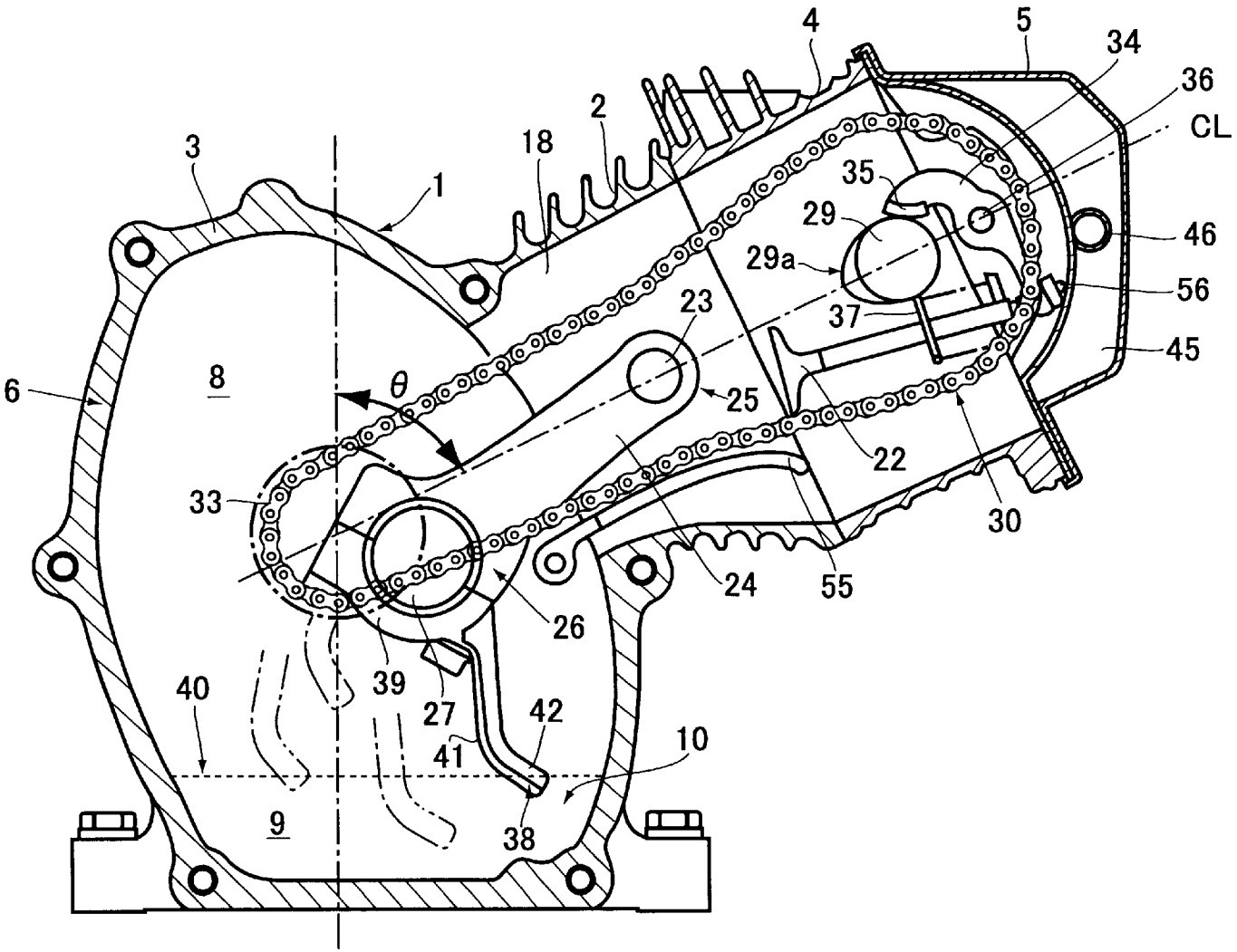
FIG. 2 is an explanatory cross-sectional view of a timing system of the engine of FIG. 1 along a direction of a cylinder axis.

An embodiment of the present invention will now be described in detail with reference to the drawings. FIG. 1 is a diagram illustrating a structure of an OHC engine using a lubricating system of a valve-operating device in one embodiment of the present invention. FIG. 2 is an explanatory cross-sectional view of the engine of FIG. 1 taken along the cylinder axis direction.

The engine of FIG. 1 is a single-cylinder 4-cycle gasoline engine, and is a so-called "inclined type of OHC engine" in which the cylinder axis CL is inclined by an angle θ with respect to the gravitational direction (see FIG. 2). In this engine, an engine body 1 includes a cylinder block 2 and a crank case 3 which are integrally formed therein. The engine body 1 is made of iron or a light metal alloy such as an aluminum alloy. A cylinder head 4 made of an aluminum alloy is attached to an upper portion of the cylinder block 2. A rocker cover 5 made of a sheet metal or a synthetic resin is mounted on a top of the cylinder head 4.

The crank case 3 has a large opening at the right side thereof in FIG. 1, thereby providing a main bearing case attachment surface 6. A main bearing case 7 made of an aluminum alloy is attached to the main bearing case attachment surface 6. Thus, a crank chamber 8 is provided in the crank case 3, and an oil pan 10 is provided under the crank chamber 8 for storing a lubricating oil (hereinafter referred to simply as "oil") 9.

A main bearing 11*a* is press-fitted into the main bearing case 7, and one end of a crankshaft 12 is supported by the main bearing 11*a*. An oil seal 13*a* is press-fitted on the outer side of the main bearing 11*a*.

A main bearing 11*b* is press-fitted into a wall surface 14 opposite to the main bearing case attachment surface 6 of the crank case 3. The other end side of the crankshaft 12 is supported by the main bearing 11*b*. Similarly, an oil seal 13*b* is provided on the outer side of the main bearing 11*b*. The oil seals 13*a* and 13*b* prevent the oil 9 stored in the oil pan 10 from leaking out of the crank case 3 along the crankshaft 12.

A flywheel 15 and a cooling fan 16 are attached to an end portion of the crankshaft 12 that extends out of the crank case 3 through the wall surface 14. The cooling fan 16 is provided outside the crank case 3 and within a casing 57, and rotates together with the crankshaft 12 so as to induce a cooling air from an outside of the casing 57. The engine body 1, the cylinder head 4, etc. are cooled by the induced cooling air. Moreover, a recoil device 17 is provided on the outer side of the casing 57. By pulling a recoil lever 17*a* by hand, the crankshaft 12 is rotated to start the engine.

A cylinder bore 18 is provided in the cylinder block 2. A piston 19 is fitted within the cylinder bore 18 so as to be slidable therein. An upper end of the cylinder bore 18 is closed by the cylinder head 4, and an upper surface of the piston 19 and a bottom wall surface 20 of the cylinder head 4 form a combustion chamber 21 together. An intake valve 22, an exhaust valve (not shown), an ignition plug (not shown), etc. are provided in the upper portion of the combustion chamber 21.

A small end portion 25 of a connecting rod 24 is rotatably connected to the piston 19 via a piston pin 23. A crank pin 27 of the crankshaft 12 is rotatably connected to a large end portion 26 of the connecting rod 24. Thus, the crankshaft 12 is rotated along with the vertical reciprocation of the piston 19.

On the other hand, a camshaft 28 is provided in the cylinder head 4 parallel to the crankshaft 12 on the cylinder axis CL. The camshaft 28 includes a valve-operating cam 29 and a sprocket 31, which are integrally formed with each other. The valve-operating cam 29 is driven in synchronization with the crankshaft 12 by a timing system 30.

A sprocket 32 is secured on the crankshaft 12. Chain chambers 50, 51 are provided in the cylinder block 2 and the cylinder head 4, respectively, and the sprocket 31 and the sprocket 32 are connected to each other via a chain 33 provided in the chain chambers 50 and 51. The sprockets 31, 32 and the chain 33 form the timing system 30 together. The number of teeth of the sprocket 31 is twice as large as the number of teeth of the sprocket 32, so that the valve-operating cam 29 undergoes one revolution per two revolutions of the crankshaft 12. Also, an appropriate tension is applied to the chain 33 by a chain tensioner 55.

The valve-operating cam 29 is provided with a cam surface 29*a*, and a slipper 35 formed at one end of a rocker arm 34 slidably contacts with the, cam surface 29*a*. The valve-operating cam 29 and the rocker arm 34 form a valve-operating device together. Two rocker arms 34 of a rocking type are provided respectively for intaking and exhausting air. Each of the rocker arms 34 is provided to rock about a rocker shaft 36 which is supported by a rocker support 59. The other end of each rocker arm 34 is connected to a top end portion of the intake valve 22 or an exhaust valve (not shown) via an adjusting screw 56. The intake valve 22 and the exhaust valve are each driven when the rocker arm 34 is rocked by the valve-operating cam 29. The intake valve 22 and the exhaust valve are each biased by a valve spring 37 toward the closed position. Thus, the intake valve 22 is opened/closed by the rotation of the valve-operating cam 29.

Figure 3A:
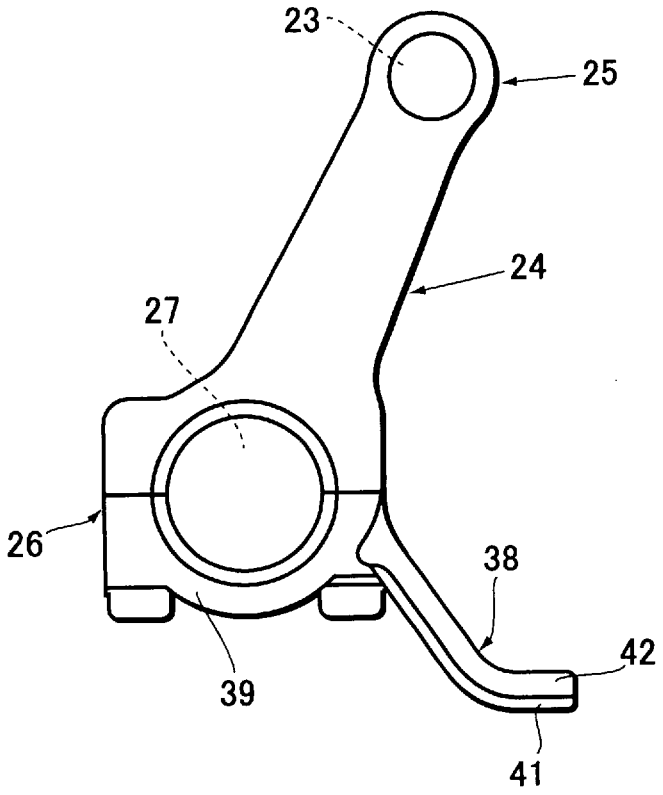
FIGS. 3*a* and 3*b* are diagrams illustrating the structure of a connecting rod including a scraper, which illustrate a front view and a side view of the scraper, respectively.
Figure 3B:
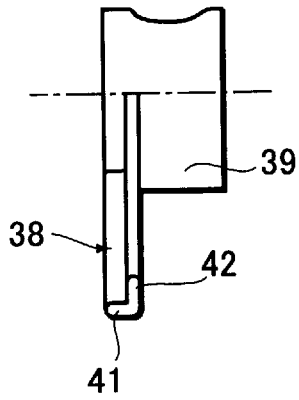

The timing system 30 is lubricated by a scraper 38 provided on a large end portion 26 of the connecting rod 24. FIGS. 3*a* and 3*b* are diagrams illustrating a structure of a connecting rod 24 including a scraper 38, which illustrate a front view and a side view of the scraper 38, respectively. Further, FIG. 4 is a perspective view of the scraper 38.

As illustrated in FIG. 2, the scraper 38 extends downward from a lower member 39 of the large end portion 26, i.e., in a radial direction of the crankshaft 12. The scraper 38 swings by the rotation of the crankshaft 12 through a path as indicated by a one-dotted-chain line in FIG. 2. Thus, the oil 9 stored in the oil pan 10 is dipped and scraped up by the scraper 38, and the oil 9 is splashed onto the chain 33 when the scraper 38 comes out of an oil surface 40, thereby lubricating the timing system 30.

Figure 4:
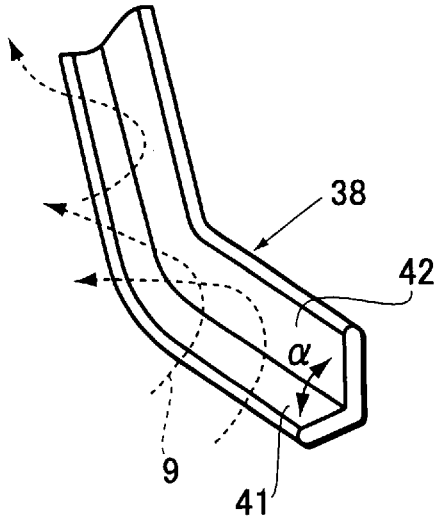
FIG. 4 is a perspective view of the scraper.

The scraper 38, having a generally L-shaped cross section, includes a bottom wall 41 and a side wall 42 extending upwardly on one lateral end of the bottom wall 41 as shown in FIG. 4. In the present embodiment, the angle $\alpha$ formed by both the bottom wall 41 and the side wall 42 is set to be 90°. However, the angle therebetween is not limited to the right angle, but may be appropriately selected in the about range of 60° to 90°.

Along with the rocking of the scraper 38, the oil 9 is dipped and scraped up by the bottom wall 41, and guided to the side wall 42 and splashed away from the side wall 42 as shown in FIG. 4. Thus, the droplets of the oil 9 are splashed also in three-dimensionally inclined directions, i.e., in the lateral direction from the scraper 38, thereby throwing some droplets of the oil 9 toward a root portion of the chain tensioner 55. Some of the droplets hit the inner wall of the crank case 3 and are bounced back toward the chain 33.

In this way, droplets of the oil 9 can be supplied to the chain 33, which is offsetted toward the main bearing case 7 with respect to the scraper 38, thereby ensuring to supply the oil 9 to the chain 33. In such a way, the timing system 30 of the OHC engine can also be securely lubricated without increasing the number of components even though the timing system 30 of the OHC engine is located at a deviated position from the longitudinal direction of the crankshaft due to the structure thereof.

The oil 9 thus splashed onto the chain 33 is transferred toward the cylinder head 4 along with the movement of the chain 33, thereby lubricating the, sprocket 31 also. Moreover, the sprocket 32 is also lubricated by the oil 9 attached on the chain 33.

On the side of the cylinder head 4, some of the oil 9 attached on the chain 33 is shaken off by a centrifugal force. As the chain 33 travels around the sprocket 31, some of the oil 9 on the chain 33 is thrown off from the chain 33 toward the circumferential directions of the sprocket 31 to be separated from the chain 33. In the illustrated engine, the rocker cover 5 is provided above the sprocket 31, and those droplets of the oil 9 hit the ceiling surface 53 of the rocker cover 5. The oil 9 attached onto the ceiling surface 53 runs down along the ceiling surface 53 back into the oil pan 10 via the chain chambers 51 and 50.

In the present invention, an oil dripping portion 54 having a convex shape are provided on one part of the ceiling surface 53 of the rocker cover 5 as shown in FIG. 1, so that the oil 9 attached onto the ceiling surface 53 drips from the oil dripping portion 54. This oil dripping portion 54 is positioned above a contacting portion between the valve-operating cam 29 and the slipper 35, thereby lubricating the contacting portion by the oil 9 dropped therefrom.

In the cylinder head 4, a gas-liquid separation chamber 43 is further provided separately from the chain chamber 51. Another gas-liquid separation chamber 45 is provided in the rocker cover 5 and is communicated to the gas-liquid separation chamber 43 via a lead valve 44. The gas-liquid separation chamber 45 is further connected to an air cleaner 47 via a blow-by passage 46. The air cleaner 47 is further connected to an intake port 49 in the cylinder head 4 via a carburetor 48.

The gas-liquid separation chambers 43,45 are provided for separating a mist of the oil 9 from a blow-by gas when the blow-by gas stored in the crank chamber 8 is recirculated to the air cleaner 47. In the illustrated engine, the gas-liquid separation chamber 43 is opened to the chain chamber 50, which is provided separately from the cylinder bore 18. Specifically, a gas inlet 52 is provided at an upper end portion of the chain chamber 50 of the cylinder block 2, and the blow-by gas, which has flowed into the chain chamber 50, flows into the gas-liquid separation chamber 43 via the gas inlet 52. As the blow-by gas flows through the gas-liquid separation.chamber 43, the oil mist contained therein attaches to a wall surface of the gas-liquid separation chamber 43, thereby separating the oil mist from the blow-by gas. The oil component, which has been separated in the gas-liquid separation chamber 43, returns to the oil pan 10 via the wall surfaces of the gas-liquid separation chamber 43 and then the chain chamber 50.

The blow-by gas, which has flowed into the rocker cover via the lead valve 44, is subjected to a further oil mist separation process in the gas-liquid separation chamber 45. Specifically, the oil mist contained in the blow-by gas, which has entered the gas-liquid separation chamber 45, attaches to the wall surface of the gas-liquid separation chamber 45, thereby achieving a further gas-liquid separation. Incidentally, an oil return hole (not shown) may be provided in the bottom surface of the rocker cover 5, whereby the oil, which has attached to the wall surface of the gas-liquid separation chamber 45, flows into the chain chambers 51, 50 through the oil return hole and returns to the oil pan 10 via the wall surface of the chain chambers 51, 50.

The present invention has been specifically described above based on a particular embodiment thereof. It is understood, however, that the present invention is not limited to the above-described embodiment, but rather various modifications can be made thereto without departing from the scope and spirit of the present invention.

For example, the scraper 38 may have not only a generally L-shaped cross section as described in the above embodiment, but also one of an acute angle or an arcuated shape in which the bottom wall and the side wall are continuously formed.

Moreover, while the present invention is applied to an air-cooled engine with a single-cylinder, the present invention may alternatively be applied to an air-cooled engine with a multi-cylinder, or a liquid-cooled engine with a single- or multi-cylinder. In addition, although the cylinder block 2 and the crank case 3 are formed integrally with each other in the embodiment described above, they may alternatively be provided separately, and further the cylinder head 4 and the cylinder block 2 may be formed integrally with each other.

Furthermore, the timing system 30 is provided by using the sprockets 31,32 and the chain 33 in the embodiment described above, but the timing system 30 may alternatively be provided by using other driving members known in the art, such as a cogged pulley and a cogged belt, or a timing pulley and a timing belt. Moreover, in the present invention, the term "rotation" has a general concept including a circular motion in both directions, i.e., a clockwise direction and a counterclockwise direction, not a circular motion in only one direction.

According to the lubricating system for the OHC engine of the present invention, the scraper is provided on a large end portion of a connecting rod with a L-shaped cross-section constructed by a bottom wall and a side wall, thereby allowing the droplets of the oil to be splashed in three-dimensional inclined directions, i.e., the side direction also of the scraper. Therefore, the droplets of the oil can be attached to the timing system also which is located at the deviated portion from the scraper in the longitudinal direction of the crankshaft. That is, even in the case of the OHC engine, the timing system of which is offsetted from the scraper, it becomes possible to securely lubricate the timing system without adding components such as an oil dipper according to the present invention.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A lubricating system of an overhead camshaft engine having a valve-operating cam provided on a cylinder head of the engine and driven in synchronization with a crankshaft via a timing system, the timing system being offset from a connecting rod in a direction of a crank shaft, comprising:

a scraper provided on a large end portion of the connecting rod of the engine and including a bottom wall extending in a radial direction of the crankshaft and a side wall erected from the bottom wall on a side opposite to the timing system in order to pick up a lubricating oil stored in a lower portion of a crank case of the engine so as to lubricate said timing system.

2. The lubricating system of the overhead camshaft engine according to claim 1, wherein said engine is an inclined type of engine which has a cylinder axis inclined with respect to a gravitational direction.

3. The lubricating system of the overhead camshaft engine according to claim 1, wherein an angle formed between said bottom wall and said side wall is in a range of 60° to 90°.

4. The lubricating system of the overhead camshaft engine according to claim 2, wherein an angle formed between said bottom wall and said side wall is in a range of 60° to 90°.

5. The lubricating system of the overhead camshaft engine according to claim 1, wherein said scraper has an arc-shaped cross section in which the bottom wall and the side wall are continuously formed.

6. The lubricating system of the overhead camshaft engine according to claim 1, wherein said timing system comprises sprockets and a chain for carrying the lubricating oil to the valve-operating cam.

* * * * *